US007810907B2

(12) United States Patent
Kubo et al.

(10) Patent No.: US 7,810,907 B2
(45) Date of Patent: Oct. 12, 2010

(54) BOARD FOR INKJET PRINTING HEAD AND INKJET PRINTING HEAD USING THE SAME

(75) Inventors: Kousuke Kubo, Yokohama (JP); Yoshiyuki Imanaka, Kawasaki (JP); Takuya Hatsui, Tokyo (JP); Souta Takeuchi, Yokohama (JP); Takaaki Yamaguchi, Yokohama (JP); Takahiro Matsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1182 days.

(21) Appl. No.: 11/400,335

(22) Filed: Apr. 10, 2006

(65) Prior Publication Data

US 2006/0232633 A1 Oct. 19, 2006

(30) Foreign Application Priority Data

Apr. 18, 2005 (JP) ..... 2005-120017

(51) Int. Cl.
*B41J 2/14* (2006.01)

(52) U.S. Cl. ..... 347/50; 347/58; 347/59; 347/57; 347/56

(58) Field of Classification Search ..... 347/50, 347/56–59, 13, 148
See application file for complete search history.

(56) References Cited

U.S. PATENT DOCUMENTS 5,243,363 A * 9/1993 Koizumi et al. ..... 347/50
5,745,136 A * 4/1998 Saito ..... 347/50
5,943,070 A 8/1999 Kamiyama et al.
6,231,165 B1 * 5/2001 Komuro ..... 347/58
6,257,695 B1 7/2001 Kamiyama et al.
6,290,334 B1 * 9/2001 Ishinaga et al. ..... 347/59
6,409,315 B2 6/2002 Komuro
6,471,339 B1 10/2002 Kamiyama et al.
6,962,405 B2 11/2005 Imanaka et al.
2005/0128254 A1 6/2005 Ibe et al.
2005/0179730 A1 * 8/2005 Majima et al. ..... 347/50
2006/0125881 A1 6/2006 Kubo et al.

FOREIGN PATENT DOCUMENTS

JP 10-44416 A 2/1998

* cited by examiner

*Primary Examiner*—Matthew Luu
*Assistant Examiner*—Henok Legesse
(74) *Attorney, Agent, or Firm*—Fitzpatrick, Cella, Harper & Scinto

(57) ABSTRACT

Provided is a configuration for connecting common wires (a common power supply wire for connecting a plurality of printing elements commonly to a power supply and a common ground wire for connecting the plurality of printing elements commonly to a ground) to the outside, which configuration does not obstruct a constitution for reducing resistances of the common wires. For this purpose, the common wires are directly connected respectively to electrode leads of an electric wiring tape for external connection without use of electrode pads. In the case of this configuration, the widths of the common wires need not be narrower in vicinities of the electrode pads which would otherwise be in an edge of the board, and accordingly reduction of resistances of the common wires is not obstructed.

7 Claims, 11 Drawing Sheets

BOARD FOR INKJET PRINTING HEAD AND INKJET PRINTING HEAD USING THE SAME

BACKGROUND OF THE INVENTION

1. Field of the Invention

The present invention relates to a board for an inkjet printing head which performs printing operation by ejecting ink onto a printing surface of a printing medium, and to an inkjet printing head using the board. In particular, a board for a printing head, to which the present invention is applied desirably, is that in which elements to generate energy are arranged on one of its sides (top surface). The energy is used for ejecting ink in a direction perpendicular to the board in accordance with its drive. In addition, the board includes a plurality of ink supply ports each shaped like a long groove, which penetrate through the board from a side (back surface) opposite to the top surface, and which introduce the ink onto the aforementioned elements. The board also includes electrode pads along outer peripheral edges of the board, the edge being parallel to short sides of the ink supply ports each shaped like a long groove.

2. Description of the Related Art

FIGS. 9 and 10 show a conventional example of such an inkjet printing head (hereinafter also referred to as a "printing head") used for an inkjet printing apparatus. FIG. 9 is a perspective view showing a part of the board by cutting away a part of a member in which ejection openings and the like are formed. FIG. 10 is a plan view mainly showing power supply wires on the board for the printing head.

In the case of the printing head of this type, as shown in FIG. 9, a plurality of heating portions (hereinafter also referred to as "heaters") 802 are provided to the top surface of a board 805, and the heating portions are arranged in a staggered pattern in which an arrangement of heating portions along one side of an ink supply port 803 is shifted from an arrangement of heating portions along the other side of the ink supply port 803, the port penetrating through the board. In addition, a member in which ink ejection openings 801 and ink passages 804 are formed is disposed on the board 805. The ink ejection openings 801 and the ink passages 804 correspond to the plurality of heating portions 802, and the ink is ejected through each of the ink ejection openings 801 and the ink passages 804.

The following components are provided on the board 805 as shown in FIG. 10 for the purpose of ejecting the ink by selectively driving the plurality of heaters 802 in accordance with printing data. The components include:

common wires 902*a* and 902*b* which are connected to the power supply;

power supply wires 910 for supplying power to the heating portions 802 respectively;

driving elements such as transistors (located in hatched parts in the drawing, constituting as lower layers under the heating portions and their related wire layers, and formed in the board); and wires or circuits, such as common wires 904*a* and 904*b* which are connected to the ground (GND).

In addition, the common power supply wires and the common GND wires can be electrically connected to the outside of the board through electrode pads 903 respectively. Incidentally, illustration of required interlayer insulating films and protective films is omitted from the drawing. The interlayer insulating films are arranged in conjunction with layers for forming the heaters, electrode layers and driving elements. The protective films are used for protecting the heaters, electrode layers and driving elements from the ink.

In the inkjet printing head having the above-described configuration, ink is held in a state in which the ink forms a meniscus in the vicinity of each ejection opening 801. The heating portions 802 are selectively driven in accordance with recording data in this state, and the thermal energy generated is utilized to sharply heat and boil the ink on a heat applying surface. Thus, ink can be ejected by the pressure of bubbles generated at this time.

Incidentally, electric energy or power which is applied to the heating portions in order to eject ink is one of important factors which influence the ejection. That is, when the applied electric energy varies, a foaming phenomenon also varies accordingly, and favorable ejection may not be performed.

In a case where, for example, the applied driving energy is small, the film boiling phenomenon of the ink is prone to become unstable due to a lack of energy. As a result, a satisfactory film boiling does not take place. Accordingly, this fluctuates ejection speed, ejection direction and an amount of ejected ink. In some cases, these may deteriorate the quality of printed images. In contrast, in a case where the applied driving energy is high, excessive thermal energy gives mechanical stress to the heating portions 802, and changes the film quality. These may also cause the ejection failure as described above. In the worst case, the printing head may be broken. With this taken into consideration, it is desirable that energy to be applied to each of the heaters should always be almost entirely uniform.

On the other hand, known factors that cause fluctuations in energy applied to each heating portion also include one caused by the fact that the number of heating portions simultaneously driven changes in one recording head. That is, if the number of heating portions simultaneously driven changes depending on recording data or the like, a voltage drop generated changes accordingly. As a result, the driving energy of each heating portion changes.

A configuration disclosed, for example, in Japanese Patent Application Laid-open No. 10-44416 (1998) has been heretofore one of countermeasures against these problems. In the case of this configuration, as shown in FIG. 10, each common wire between the corresponding heaters 802 and the corresponding electrode pad as well as each common wire between the corresponding driving elements and the corresponding electrode pad is divided into the plurality of sections. Each of the sections includes a unit consisting of a certain number of heating portions and driving elements. Further, values of wire resistances of the common wires 902*a*, 902*b*, 904*a* and 904*b* are made approximately equal to one another. This configuration makes it possible to decrease the difference in voltage drop between the case where all the heaters are driven for any one of the common wires corresponding respectively to the units and the case where one heater is driven for the same common wire. Furthermore, among of the heaters connected to each of the common wires, a single heater is to be driven at a time. This makes it possible to eliminate the difference between the case where all the heaters would otherwise be driven for the same common wire and the case where the single heater is driven for the same common wire. Accordingly, this makes it possible to always apply constant driving energy to each of the heaters.

This configuration is adopted for the purpose of reducing a particular type of voltage drop, which occurs for the following cause, among various types of voltage drops which may occur when the heating portions are driven. The cause is that, in a case where a one-piece common wire covers all the heating portions, the length of the common wire to each of the heaters differs from one heaters to another depending on the positions of the heating portions. In the case of a configuration disclosed in Japanese Patent Application Laid-open No. 10-44416 (1998), basically, wire resistance is intended to be reduced by making the widths of the common wires as large as possible, for the purpose of reducing voltage drop. On the basis of this, the wire resistances respectively of the electrode wires are designed to be equal to each other by making the widths of the wires different from each other depending on the lengths of the wires to the corresponding units as shown by reference symbols A and B in FIG. 10.

Among inkjet printing apparatuses of these years, however, apparatuses using printing heads with the following configuration have come mainstream. In the case of this configuration, each of such printing heads includes a plurality of ink supply ports in one board, and a plurality of heaters are integrated in a high density in association with each of the ink supply ports, for the purpose of making it possible to record high-definition images each with high image quality at a high speed. For this reason, if the number of simultaneous drives is increased on the basis of the aforementioned prior art for the purpose of realizing the high-speed printing, the connection using the divided wires increases a total of the widths of the wires to a large extent. A resultant drastic enlargement of the size increases costs.

On the other hand, there has been a tendency that printing heads and the like become miniaturized, and this tendency imposes a restriction that the printing heads can not be constructed in a larger size easily. Under such a restriction, it is very difficult to miniaturize boards as long as the conventional connection method using divided wires continues to be used.

With this taken into consideration, the aforementioned divided wires are designed to be used as common wires with low resistance. This makes it possible to check boards from being constructed in a larger size. For the purpose of reducing resistance, it is a general practice to form the common wires in a thicker and wider film. Moreover, for the purpose of electrically connecting a board for an inkjet printing head to the outside, it is a general practice to use electrode pads arranged in an edge of the board for an inkjet printing head.

In addition to the aforementioned common wires, however, wires for individually driving the heaters in accordance with printing data are needed for the board for an inkjet printing head. For this reason, a number of electrode pads have to be arranged in the board for an inkjet printing head. This imposes a limit on areas respectively of the electrode pads in the edge of the board. Consequently, even if the widths of the common wires are wider on the surface of the board, the widths of the common wires have to be equal to or less than those of the electrode pads in the vicinities of the electrode pads for the purpose of connecting the common wires respectively to the electrode pads (see FIG. 11). This increases values of the wire resistances in the edge of the board for an inkjet printing head. Accordingly, this brings about a problem of offsetting the advantage that the common wires are made wider for the purpose of reducing the resistances.

SUMMARY OF THE INVENTION

The present invention has been made for the purpose of solving the aforementioned problems. An object of the present invention is to provide a configuration for connecting common wires to the outside, which does not obstruct a constitution for reducing the resistances of the common wires.

In an aspect of the present invention, there is provided a board for an inkjet printing head comprising:

a plurality of printing elements;

a driving circuit for driving the plurality of printing elements individually;

a common power supply wire for connecting the plurality of printing elements commonly to a power supply;

a common ground wire for connecting the plurality of printing elements commonly to a ground; and a driving signal wire which is wired in a lower layer under the common power supply wire and the common ground wire for the purpose of giving driving signals to the driving circuit, wherein the signal wire is connected to an external electrode lead through an electrode pad, and wherein, on the other hand, the common power supply wire and the common ground wire are constructed to be capable of being directly connected respectively to external electrode leads without use of electrode pads.

In the case of the present invention, a configuration in which the common wires (common power supply wires and common ground wires) are connected directly to the electrode leads of the outside is adopted. For this reason, the widths of the wires need not be narrower in the vicinities of the electrode pads which would otherwise be in the edge of the board. Accordingly, the reduced resistances, which is characteristic of the common wires, are not obstructed.

In addition, as to the board, the configuration has no electrode pad for common wires. This makes it possible to check the board for an inkjet printing head from being constructed in a larger size, and to prevent cost increases.

The above and other objects, effects, features and advantages of the present invention will become more apparent from the following description of embodiments thereof taken in conjunction with the accompanying drawings.

BRIEF DESCRIPTION OF THE DRAWINGS

FIG. 1A being a perspective view of the configuration of the printing head cartridge using the printing head and FIG. 1B being an exploded perspective view of FIG. 1A;

DETAILED DESCRIPTION OF PREFERRED EMBODIMENTS

Hereinafter, descriptions will be provided for the embodiments of the present invention with reference to the drawings.

First Embodiment

Figure 1B:
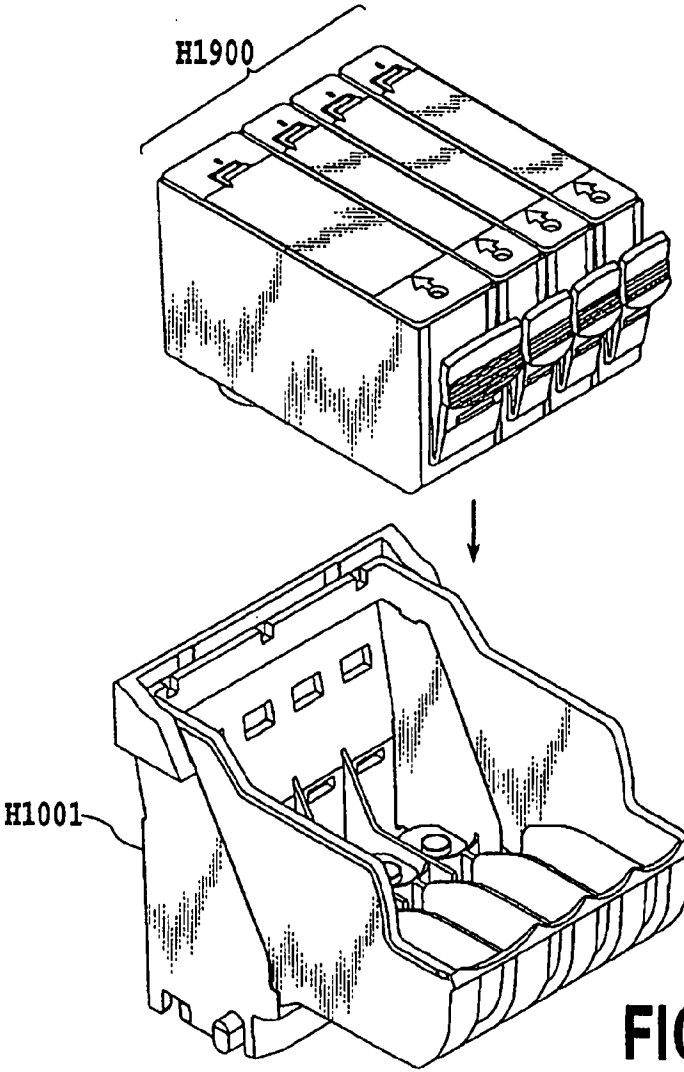
FIGS. 1A and 1B are diagrams showing a configuration of a printing head cartridge using a printing head according to an embodiment of the present invention.
Figure 1A:
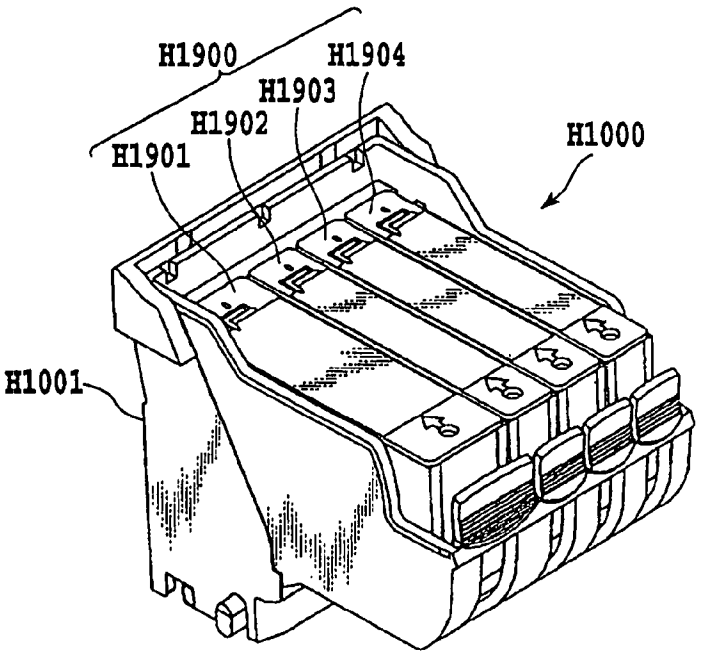

FIGS. 1A and 1B are perspective views showing a printing head cartridge H1000, to which a printing head H1001 according to an embodiment of the present invention can be applied.

As seen from these drawings, the printing head (an inkjet printing head) H1001 according to this embodiment is a component constituting the printing head cartridge H1000. This printing head cartridge H1000 is configured of the printing head H1001 as well as ink tanks H1901, H1902, H1903 and H1904 which are detachably provided to the printing head H1001. These ink tanks can be assigned to inks (printing liquids) of black, cyan, magenta and yellow. The printing head H1001 ejects inks, which are supplied respectively from the ink tanks H1900, from ejection openings in accordance with printing information.

This printing head cartridge H1000 is fixed to, and is supported by, positioning means and electrical contact points of a carriage (not illustrated) which is placed and held in the main body of an inkjet printing apparatus. The printing head cartridge H1000 can be attached to, and detached from, the carriage. The printing head H1001 performs printing operation by means of resistive elements. The resistive elements generate thermal energy for causing film boiling to take place in the inks in accordance with electric signals.

Figure 2:
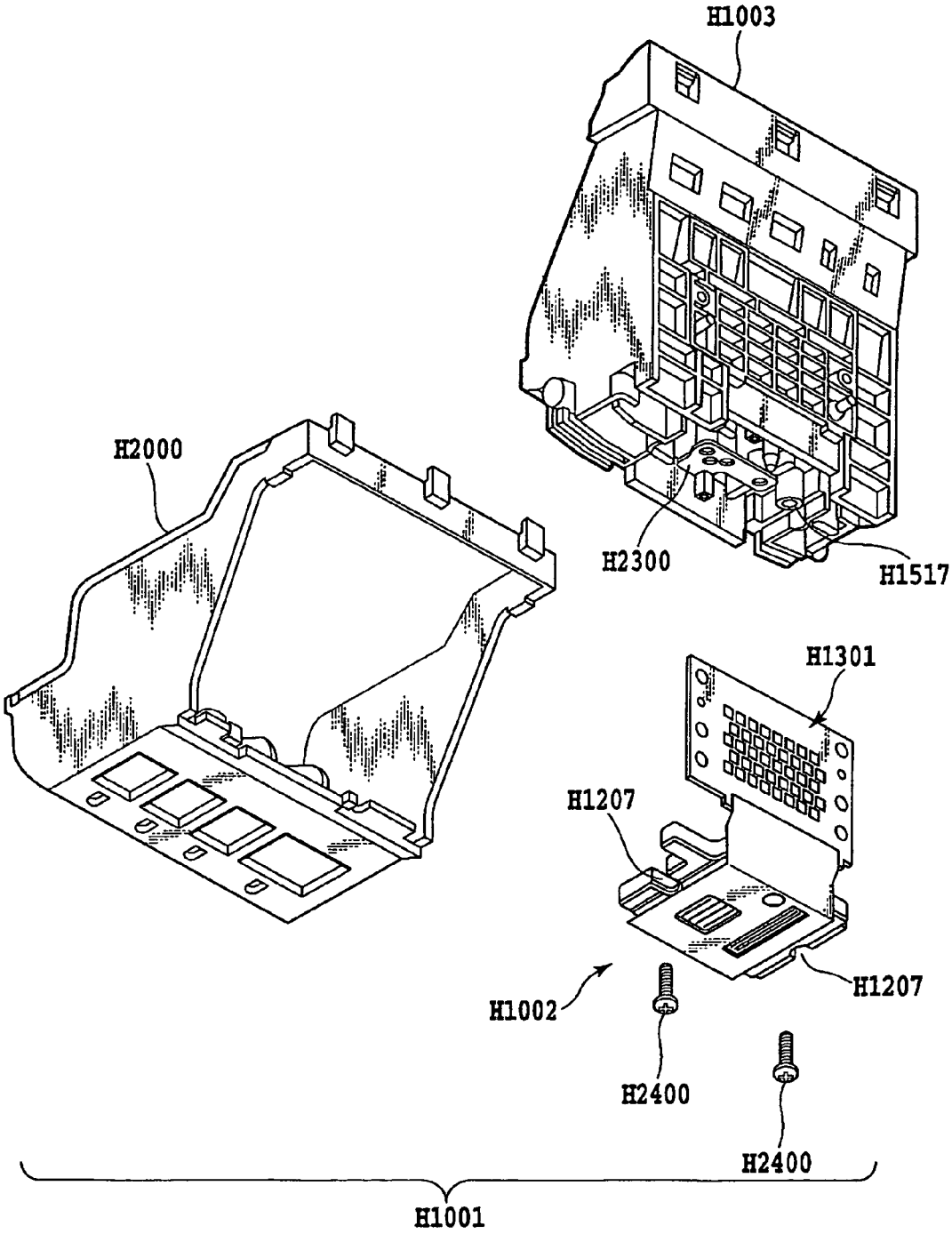
FIG. 2 is an exploded, perspective view of the printing head shown in FIGS. 1A and 1B.

FIG. 2 is an exploded, perspective view of the printing head H1001. As shown in FIG. 2, the printing head H1001 is configured of a printing element unit H1002, an ink supply unit (printing-liquid supply means) H1003 and a tank holder H2000. Incidentally, for the purpose of causing ink-communicating ports of the printing element unit H1002 and those of the ink supply unit H1003 with each other with no ink leaked, a joint seal member H2300 is interposed therebetween. The joint seal member H2300 is fixed to the peripheries of the respective communicating ports by applying pressure. In addition, the printing element unit H1002 is fixed to the ink supply unit H1003 by screwing screws H2400 respectively into screw-fastening boss portions H1517 of the ink supply unit H1003 through two screw fixation positions H1207 of the printing head unit H1002.

Figure 3:
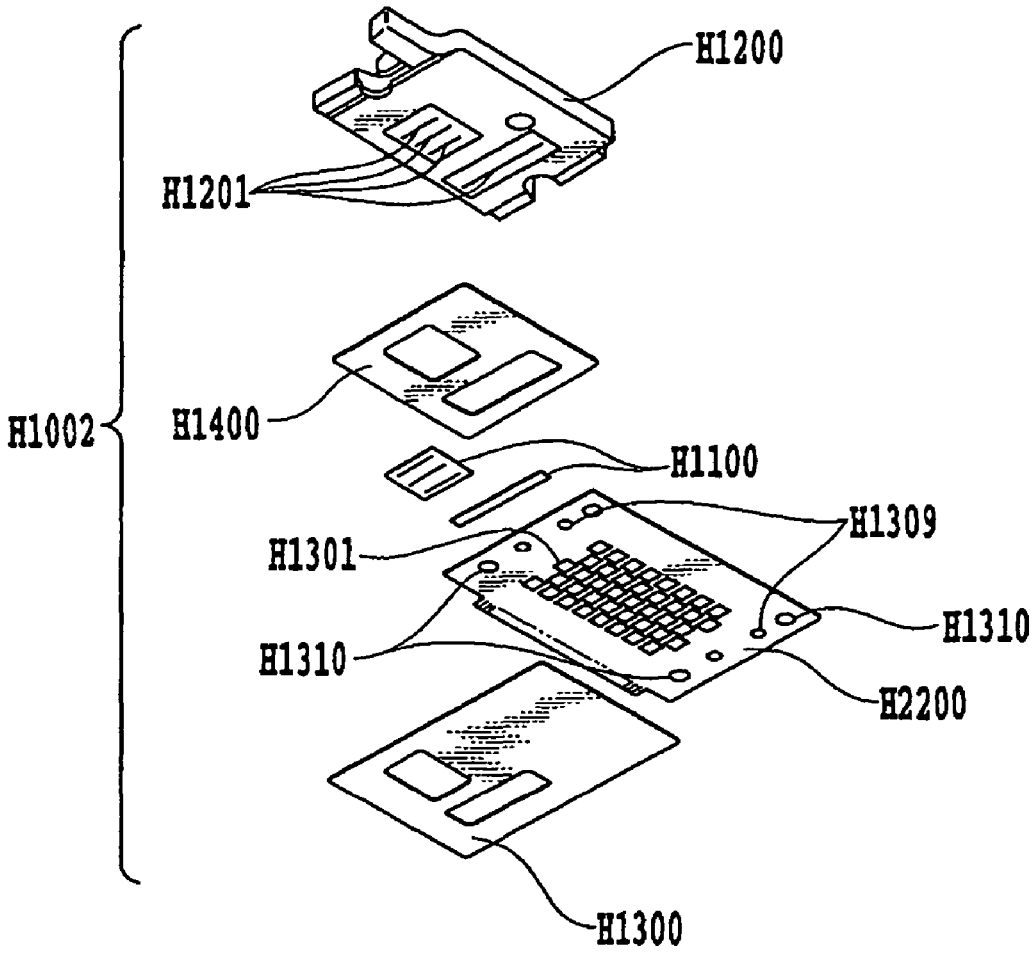
FIG. 3 is an exploded, perspective view of a printing element unit shown in FIG. 2.

FIG. 3 is an exploded, perspective view of the printing element unit H1002. The printing element unit H1002 is configured of the following components:

two types of boards H1100 for an inkjet printing head;

a first plate H1200 which is a support member;

an electric wiring tape H1300 which is a flexible wiring board;

an electrical contact board H2200; and a second plate H1400 which is a second support member, and which serves as a portion for holding the printing element boards.

The two types of boards H1100 for an inkjet printing head are adhered to, and are fixed to, the first plate H1200. The second plate H1400 including opening portions is adhered to, and is fixed to, the first plate H1200. In addition, the electric wiring tape H1300 is adhered to, and is fixed to, the second plate H1400. Thus, their positional relationship to the boards H1100 each for an inkjet printing head is maintained. The electric wiring tape H1300 applies electric signals for ejecting the inks to the boards H1100 each for an inkjet printing head. The electric wiring tape H1300 includes electric wirings corresponding to the boards H1100. Furthermore, the electric wiring tape H1300 is connected to the electrical contact board H2200. The electrical contact board H2200 includes external-signal receiving terminals H1301 which receive electric signals from the main body of the inkjet printing apparatus. The electrical contact board H2200 is fixed to the ink supply unit H1003 by positioning the electrical contact board H2200 by means of two terminal positioning holes H1309.

It should be noted that, in the case of the example illustrated in FIG. 3, a configuration including the two types of printing element boards H1100 is shown. For example, one of the two types of printing element boards H1100 is for the black ink, and the other is for the cyan, magenta and yellow inks. In the case of the former type of board H1100, heating portion columns are arranged respectively along the two sides of an ink supply port for the black ink. In the case of the latter type of board H1100, heating portion columns are arranged respectively along the two sides of an ink supply port for each of the cyan, magenta and yellow inks. Wiring of the latter type of board H1100 will be described as the following example. However, colors of ink to be used, the number of types of ink to be used, and arrangement of heating portions on each printing element board are not limited to this example.

Figure 4:
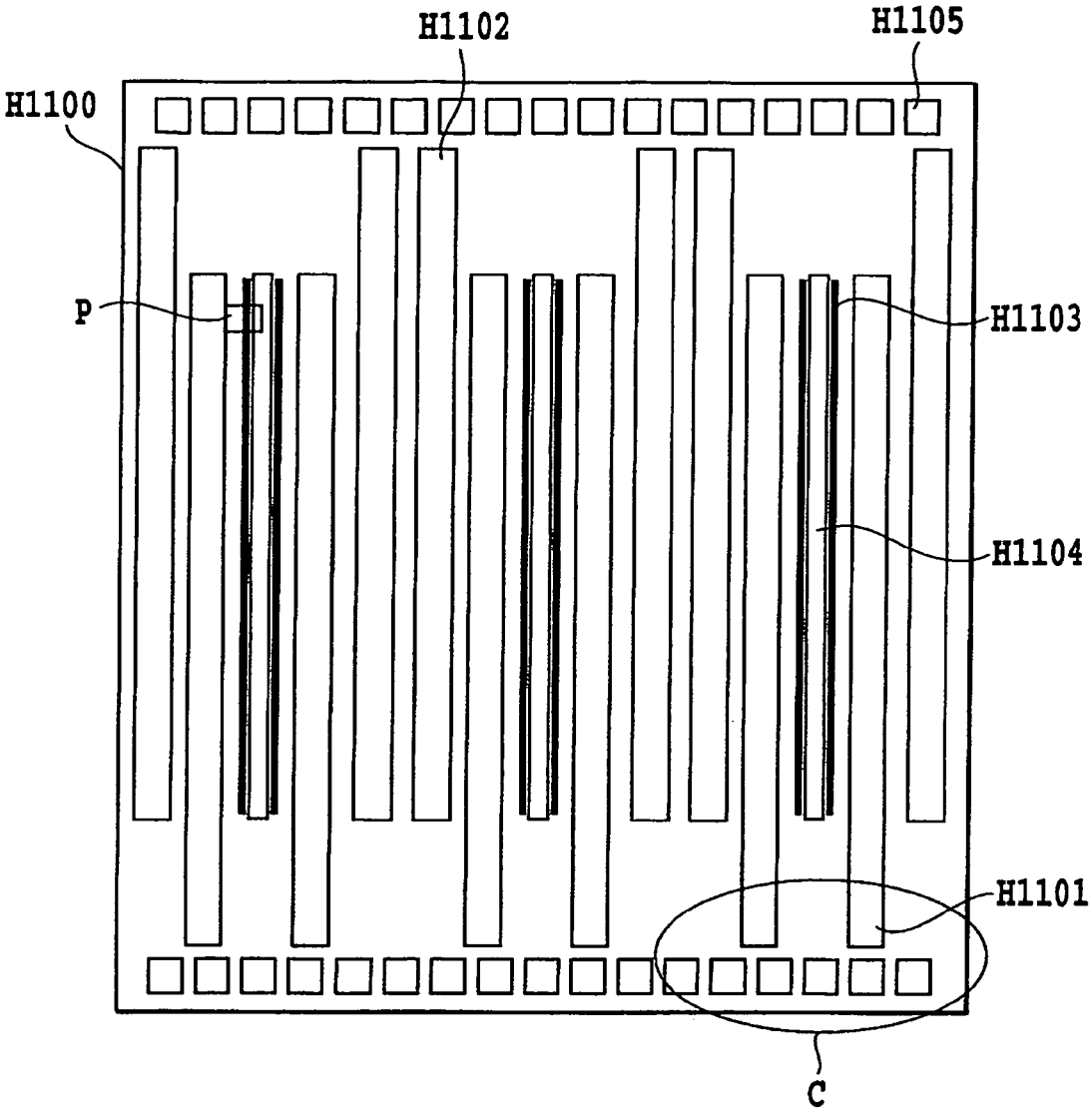
FIG. 4 is a schematic, plan view of a board for an inkjet printing head according to a first embodiment of the present invention.
Figure 5:
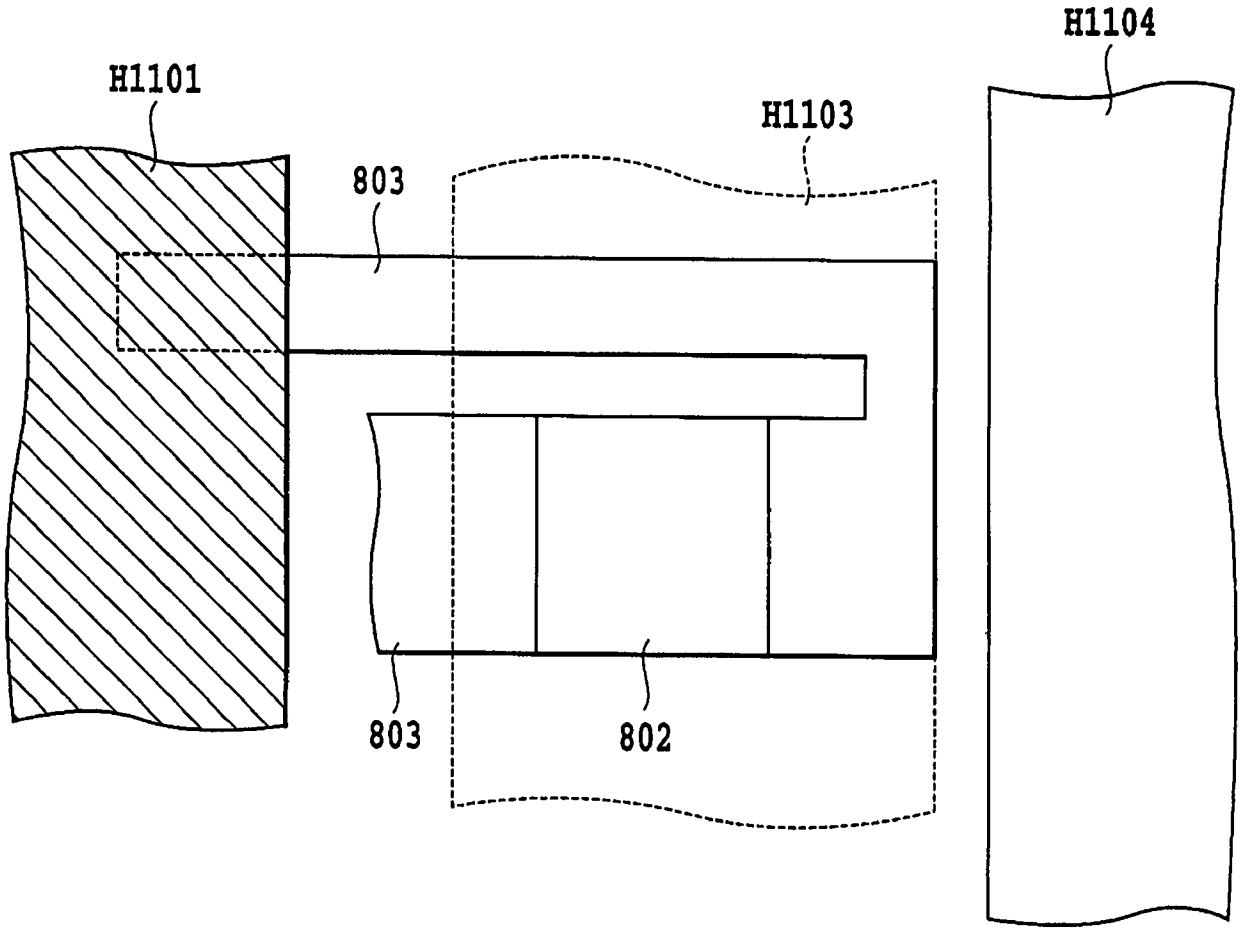
FIG. 5 is a schematic, plan view showing a heating portion and its vicinity on the board in a magnified manner, which board has been shown in FIG. 4.
Figure 6:
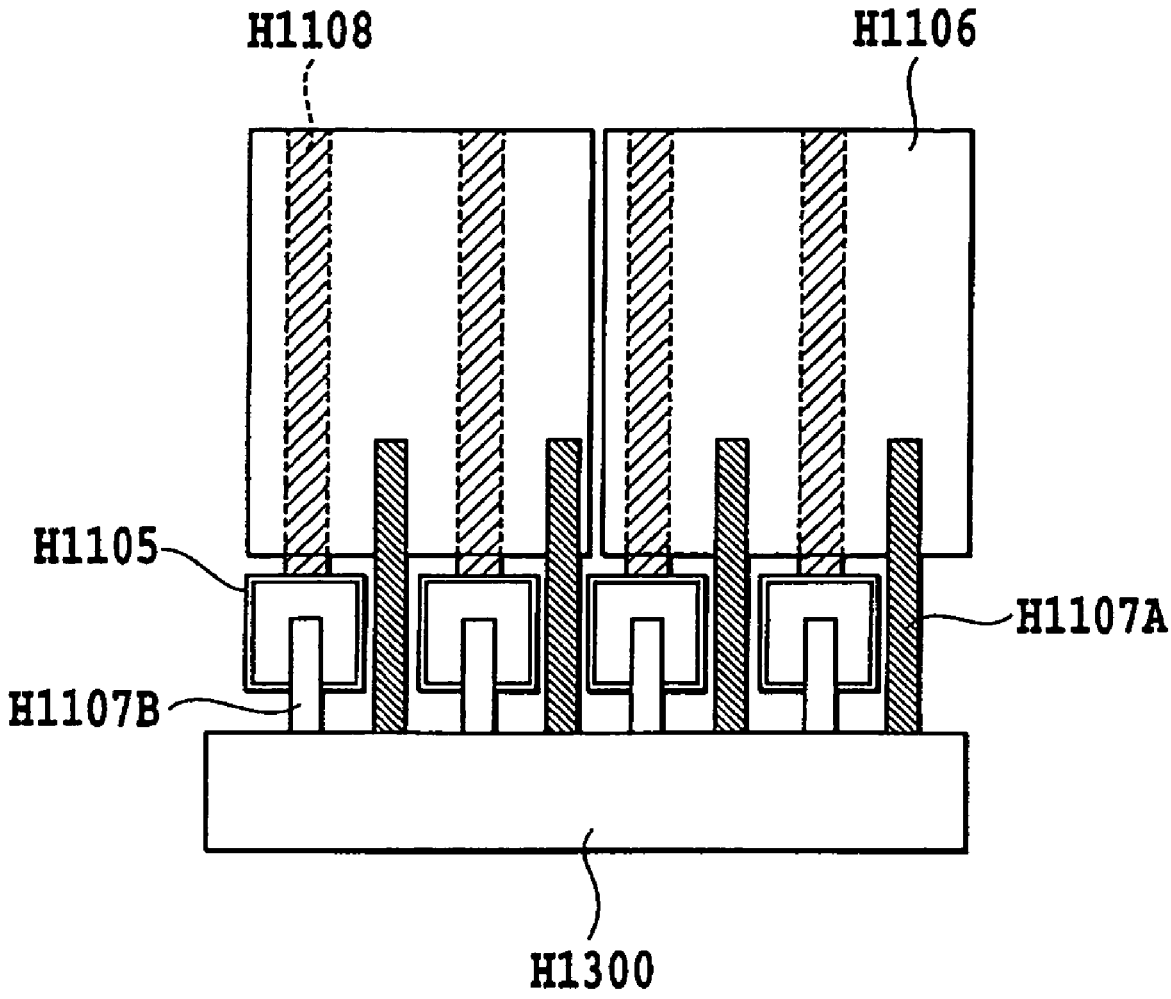
FIG. 6 is a schematic, plan view of electrode pads and their vicinities on the board shown in FIG. 4.

FIG. 4 is a plan view schematically showing a configuration of the printing element board H1100. FIG. 5 is a plan view schematically showing, in a magnified manner, a part P shown in FIG. 4 including one of heating portions arranged in the board and its vicinity. FIG. 6 is a plan view showing, in a detailed and magnified manner, a part indicated by reference symbol C in the printing element board H1100 shown in FIG. 4 (a part including electrode pads in the printing element board H1100). The printing element board H1100 includes two heating portion columns for each of the three colors of yellow, magenta and cyan in an integrated manner. Wiring on this printing element board H1100 will be described in the following example. However, it should be noted that the basic wiring configuration thereof can be applied to the printing element board for the back ink.

Figure 9:
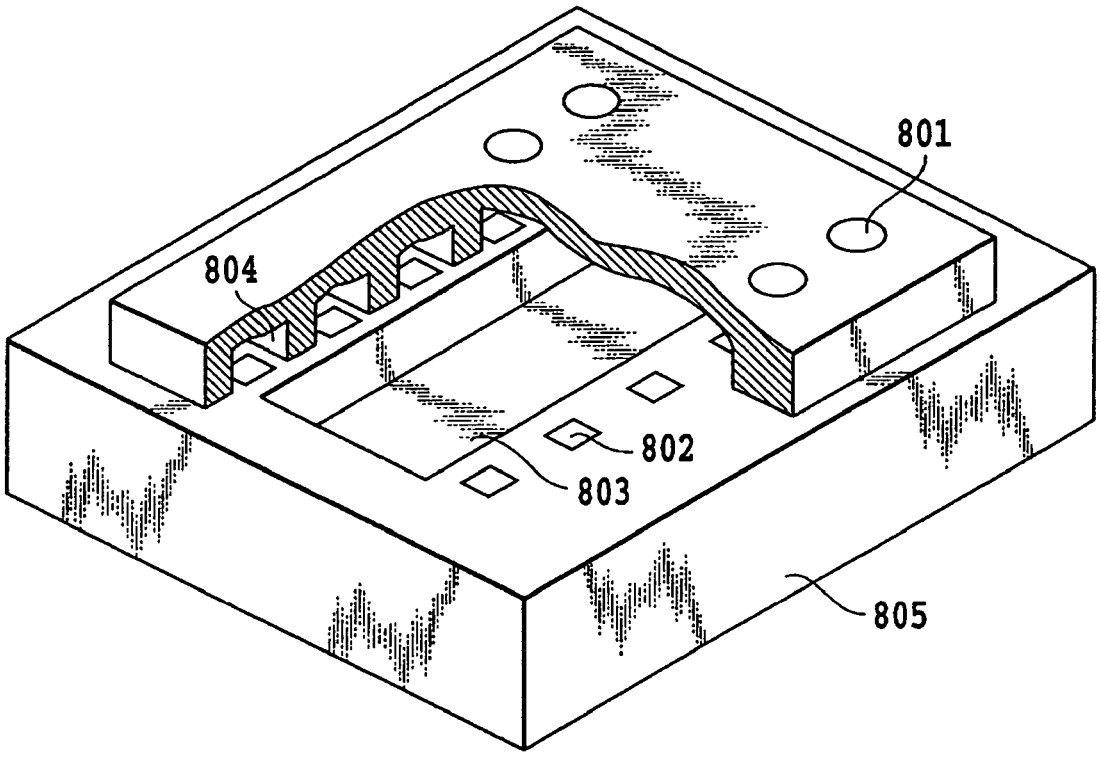
FIG. 9 is a schematic, perspective view showing an example of a general configuration of an inkjet printing head by cutting away a part of the printing head for the purpose of explaining the general configuration of the inkjet printing head.
Figure 10:
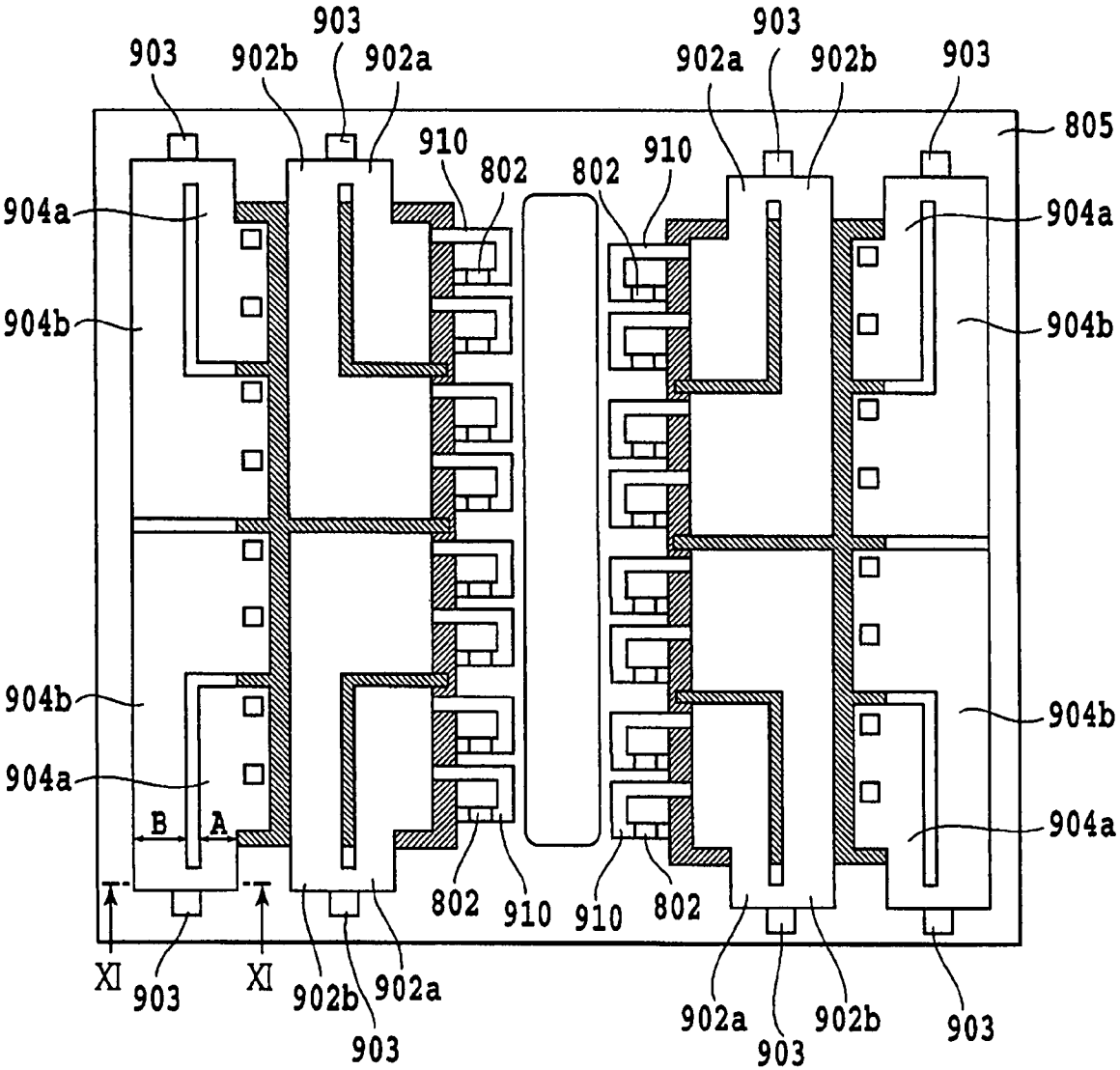
FIG. 10 is a schematic, plan view of a configuration of a conventional board, which is used for the printing head as shown in FIG. 1A, FIG. 1B, for the purpose of explaining the configuration of the conventional board.
Figure 11:
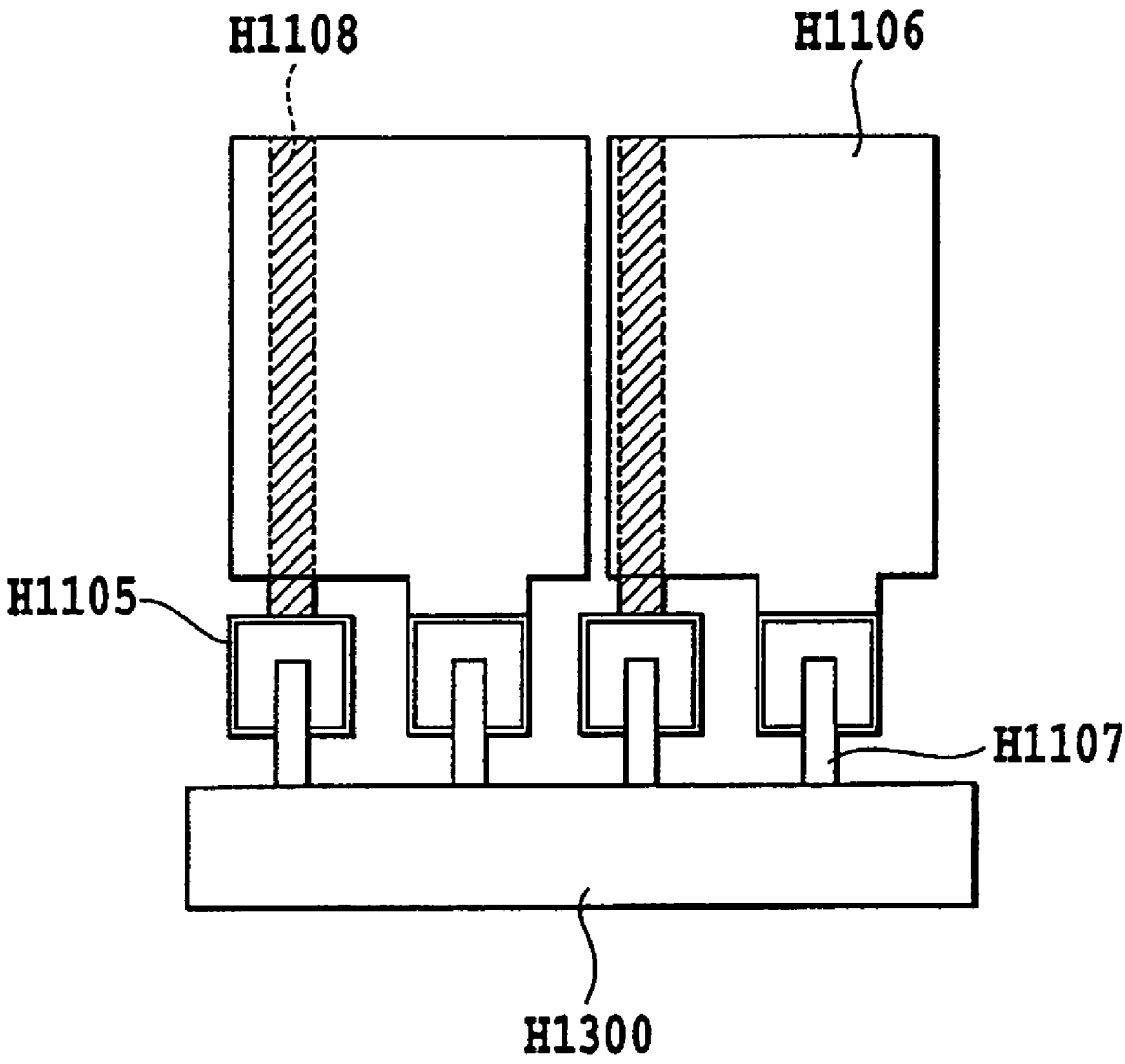
FIG. 11 is a schematic, plan view showing a configuration of electrode pads and their vicinities on the conventional board for an inkjet printing head.

The board H1100 for an inkjet printing head includes, for example, an Si substrate with a thickness of 0.5 mm to 1 mm. A plurality of heating portions 802 (as shown in FIG. 5) for ejecting ink are formed in one surface of the Si substrate. In addition, an ejection opening forming member (not illustrated) is arranged in a way that ink ejection openings of the ejection opening forming member respectively face the heating portions 802. As in the case of the general configuration shown in FIG. 9, the ejection openings communicate with ink supply port H1104 through ink passages provided in the ejection opening forming member. The ink supply ports H1104 are opened in the surface of the board H1100. Each of the ink supply ports H1104 is shaped like a long groove covering a range corresponding to arrangement of the ejection openings and the heating portions 802. The ink supply ports H1104 penetrate the board H1100, and are also opened in the back surface of the board H1100. The opening portions in the back surface thereof correspond to ink communicating ports H1201 formed in the first plate H1200. Thus, the opening portions are designed to be supplied respectively with the inks. In other words, the inks respectively supplied from the ink supply ports H1104 are ejected from the corresponding ejection openings by means of bubbles produced by heating effects of the heating portions 802.

The heating portions 802 are arranged in columns. Each two of the columns are placed respectively along the two sides of each of the ink supply ports H1104. In two of the columns, the heating portions 802 are arranged in a staggered pattern in which arrangement of the heating portions 802 in one column is shifted from arrangement of the heating portions 802 in the other column by a ½ pitch in the vertical direction in FIG. 4. Such a plurality of heating portions 802 can be formed through the following steps:

a step of preparing the substrate in which a driving circuit has been formed in advance, the driving circuit including driving elements fabricated of semiconductor elements, such as switching transistors, for driving the plurality of heating portions 802 selectively;

a step of forming the heating portion columns H1103 on the substrate, subsequently superposing, on the resultant substrate, an electrode wire layer for forming electrode wires (heater wires) 803 respectively for the heating portions 802, and thereafter forming a desired pattern by consecutively etching the heating portion columns H1103 and the electrode wire layer; and a step of further removing the electrode wire layer partially, and thereby exposing a resistor layer through the removed parts of the electrode wire layer.

One end of each of the heating portions 802 is connected to a corresponding one of the common power supply wires H1101 through a part of the corresponding one of the heater wires 803. The other end of the heating portion 802 is connected to the driving circuit formed in a lower layer through the other part of the heater wire 803 and, for example, a corresponding through-hole. This end of the heating portion 802 is connected to a corresponding one of common GND wires H1102 beyond the driving circuit.

In the case of this embodiment, two heating portion columns H1103 are provided respectively along the long sides of each of the ink supply ports H1104. Corresponding two of the common power supply wires H1101 extend respectively outside the two heating portion rows H1103, and corresponding two of the common GND wires H1102 extend respectively outside the two common power supply wires H1101. These common wires are formed in a thick and wide film by gold-plating for the purpose of decreasing the respective resistances. Each of the common wires is laid out in a way that the width of the common wire does not become narrower even in the side ends of the board in a direction orthogonal to a the arranging direction of the heating portions 802 in the heating portion columns H1103. As shown in FIG. 6, electrode leads H1107A of an edge of the electric wiring tape H1300 are connected directly to each of the common wires, for example, by means of ultra-sonic thermo-compression bonding. Incidentally, FIG. 6 shows a connecting configuration corresponding to the part C of the common power supply wires H1101 shown in FIG. 4. A similar connecting configuration is also adopted for the common GND wires H1102. With this taken into consideration, hereinafter, the common power supply wires and the common GND wires are generically referred to as "common wires" and the common wires are denoted by reference numeral H1106.

Electrode pads H1105 are arranged along opposite edges of the side ends of the board in a direction orthogonal to the arranging direction of heating portions 802. A wire H1108 for a relatively low voltage (3V to 5V) is connected to each of the electrode pads H1105. The wire H1108 is that through which driving signals are given to the driving circuit configured of a logic circuit. The driving signals are used to supply driving data for driving the plurality of heating portions for each of the colors in accordance with the respective printing data, and to supply data for determining the driving timings. In addition, an electrode lead H1107B of the electric wiring tape H1300 is connected to a bump (not illustrated) formed on each of the electrode pads H1105, for example, by means of ultrasonic thermo-compression bonding.

As described above, the common wires H1106 are connected directly to the electrode leads H1107A in the side end of the board H1100 for an inkjet printing head without use of electrode pads H1105. In addition, the electrode leads H1107A are passed through interstices between each neighboring two of the electrode pads H1105 respectively for logic wires H1108, and are wired to the common electrodes.

In this regard, conventional common wires are 0.2 μm to 0.6 μm in film thickness. If the electrode leads are caused to abut on the conventional common wires as in the case of this embodiment, it is likely that such abutting may break the logic wire layer arranged in the lower layer. In contrast to the conventional example, in this embodiment, the common wires are formed by means of the plating technique. Accordingly, the common wires are in the order of several μm to tens μm in film thickness. As a result, even if the electrode leads H1107A are connected to the common wires H1106 by causing the electrode leads H1107A to abut on the common wires H1106 directly, this abutting does not break the logic wires H1108 arranged in the lower layer. In addition, the formation of the common wires by means of the plating technique makes it possible to plate the tops of the electrode pads. Accordingly, this makes it unnecessary to form bumps in a subsequent step. Furthermore, making the electrode pads for the common wires H1106 unnecessary is effective in reducing the number of electrode pads.

As described above, the direct connection of the thickened common wires H1106 with the electrode leads H1107 makes it possible to connect the common wires H1106 with the electrode leads H1107 with reduced resistance. If, however, the thickened common wires need to be connected with the electrode leads with further reduced resistance, a plurality of electrode leads may be connected to each of the common wires H1106. FIG. 6 actually shows the example where two electrode leads H1107 are connected to one common wire H1106.

Second Embodiment

In recent years, there has been high demand for higher-speed and higher-fines printing, and this demand accelerates the mounting of multiple ink ejection openings and heating portions in higher density (for example, a pitch of 1200 dpi or higher). In conjunction with this, a larger number of logic wires and electrode pads have to be arranged in a smaller area. In such a situation, in the case of the configuration in which, like the first embodiment, the electrode leads H1107A are connected to the common wires H1106 by extending the ends of the electrode leads H1107A, it is likely that the extended ends of the electrode leads H1107A may make contact with the bumps respectively on the electrode pads H1105. With this taken into consideration, an object of this embodiment is to solve this problem.

Figure 7:
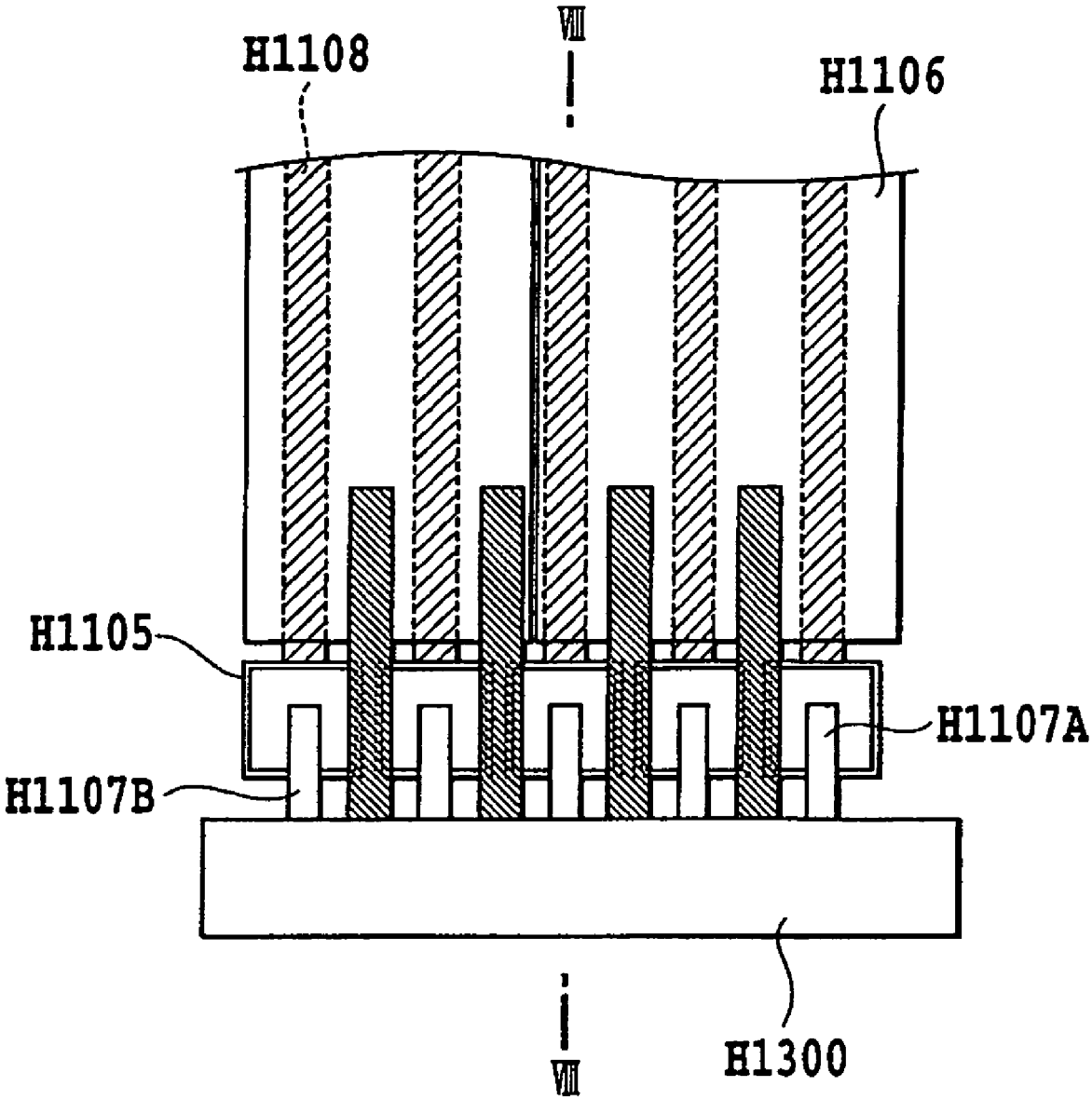
FIG. 7 is a schematic, plan view of a board for an inkjet printing head according to a second embodiment of the present invention.
Figure 8:
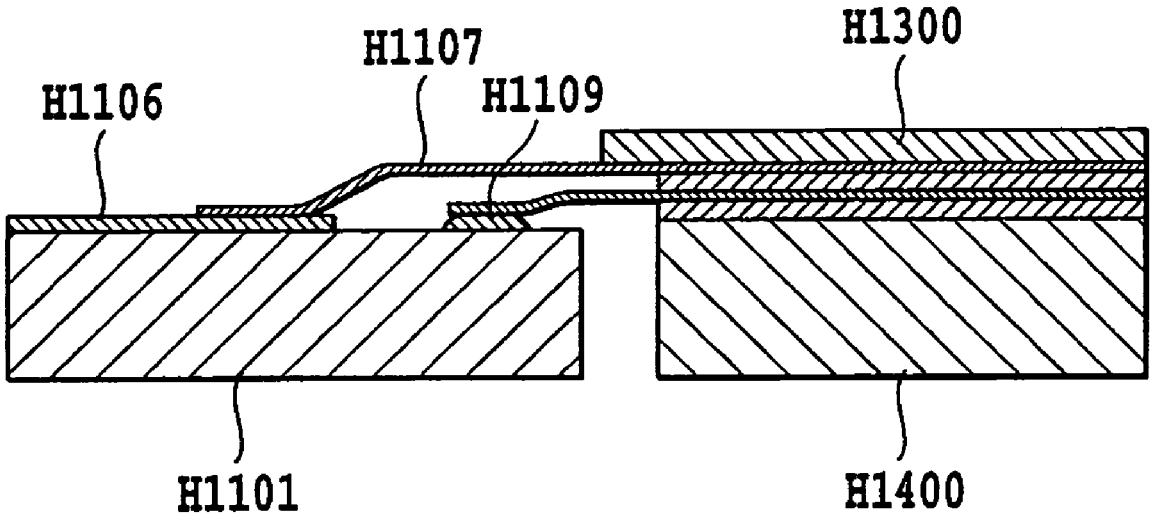
FIG. 8 is a schematic, cross-sectional view of the board for an inkjet printing head taken along the line VIII-VIII of FIG. 7.

FIG. 7 is a schematic, plan view showing a board for an inkjet printing head according to a second embodiment of the present invention. FIG. 8 is a schematic, cross-sectional view of the board for an inkjet printing head taken along the line VIII-VIII of FIG. 7.

In the case of this embodiment, the electric wiring tape H1300 is two-tiered as shown in FIG. 8. Electrode leads H1107A are arranged as upper tier of the electric wiring tape H1300, and electrode leads H1107B are arranged as lower tier of the electric wiring tape H1300. The electrode leads H1107A are connected to common wires H1106 which are situated away from the electric wiring tape, and the electrode leads H1107B are connected to bumps H1109 on electrode pads which are situated closer to the electric wiring tape.

This configuration makes it possible to connect the electrode leads H1107A to the common wires H1106 with the electrode leads H1107A passing over the electrode pads and the bumps H1109 which are situated closer to the electric wiring tape. Accordingly, this makes it possible to preclude the bumps on the electrode pads H1105 and the electrode leads from contacting each other even in a board H1100 for an inkjet printing head on which the electrode pads H1105 are arranged in high density.

Others

With regard to the aforementioned embodiments, the ultrasonic thermo-compression bonding has been cited as an example of the method of connecting the electrode leads and the electrode pads with each other, and as an example of the method of connecting the electrode leads and the common wires with each other. However, it should be noted that other connecting methods may be used.

In addition, with regard to the aforementioned embodiments, gold-plating has been cited as an example of the method of forming the common wires. However, another material may be used. Furthermore, any other forming method may be adopted as long as the forming method enables the common wires to be formed with a desired thickness.

Moreover, with regard to the aforementioned embodiments, descriptions have been provided for the case where the present invention is applied to the board for the inkjet printing head of what is termed as "side-shooter type" which ejects the inks in a direction orthogonal to the board plane. However, the present invention does not exclude its application to a board for an inkjet printing head of what is termed as "edge-shooter type" which ejects the inks in a direction parallel to the board. That is, the present invention can be effectively applied to the board for the inkjet printing head of edge-shooter type.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Application No. 2005-120017 filed Apr. 18, 2005, which is hereby incorporated by reference herein.

What is claimed is:

1. A board for an inkjet printing head comprising:

a plurality of printing elements;

a driving circuit for driving the plurality of printing elements individually;

a common power supply wire for connecting the plurality of printing elements commonly to a power supply;

a common ground wire for connecting the plurality of printing elements commonly to a ground;

a plurality of driving signal wires which are wired in a lower layer under the common power supply wire and the common ground wire for the purpose of giving driving signals to the driving circuit, a plurality of electrode pads; and a plurality of electric wiring members having a plurality of first electrode leads connected to the common power supply wire and the common ground wire and a plurality of second electrode leads connected to the driving signal wires, wherein the driving signal wires are connected to the plurality of the second electrode leads through the electrode pads, wherein the common power supply wire and the common ground wire are configured to directly connect respectively to the plurality of the first electrode leads without use of electrode pads, and wherein the first electrode leads and the second electrode leads are disposed alternately.

2. The board for an inkjet printing head as claimed in claim 1, wherein the common power supply wire and the common ground wire respectively have substantially constant widths, including their respective parts in which the common power supply wire and the common ground wire are connected respectively to the electrode leads.

3. The board for an inkjet printing head as claimed in claim 1, wherein the common power supply wire extends to a vicinity of one side end of the board in a direction parallel to a direction in which the printing elements are arranged, wherein the common ground wire extends to a vicinity of the opposite side end of the board in the direction parallel to the direction in which the printing elements are arranged, and wherein the electrode pads are arranged along the side ends.

4. The board for an inkjet printing head as claimed in claim 1, wherein each of the common power supply wire and the common ground wire is formed in a thick film.

5. An inkjet printing head comprising:

a board as claimed in claim 1;

a member in which ejection openings for ejecting ink is formed, the member being joined to a surface of the board on which the printing elements are provided; and a wiring member including electrode leads for a common wire, the electrode leads being connected respectively to the common power supply wire and the common ground wire, and electrode leads for a driving circuit, the electrode lead being connected to the electrode pads.

6. The board for an inkjet printing head as claimed in claim 4, wherein the common power supply wire and the common ground wire are formed with plating.

7. The board for an inkjet printing head as claimed in claim 6, wherein the common power supply wire and the common ground wire are formed with gold-plating.

* * * * *